US008925139B2

(12) United States Patent
Shih

(10) Patent No.: US 8,925,139 B2
(45) Date of Patent: Jan. 6, 2015

(54) SWIVEL MOP WITH REVOLVING DEHYDRATION FUNCTION

(76) Inventor: Chin-Yang Shih, Taoyuan (TW)

( * ) Notice: Subject to any disclaimer, the term of this patent is extended or adjusted under 35 U.S.C. 154(b) by 337 days.

(21) Appl. No.: 13/566,349

(22) Filed: Aug. 3, 2012

(65) Prior Publication Data

US 2014/0033460 A1 Feb. 6, 2014

(51) Int. Cl.
*A47L 13/20* (2006.01)

(52) U.S. Cl.
CPC ..... *A47L 13/20* (2013.01)
USPC ..... 15/229.1; 15/228

(58) Field of Classification Search
CPC ..... A47L 13/20; A47L 13/256; A47L 13/24; A47L 13/255
USPC ..... 15/228, 229.1, 229.2, 229.6, 119.1, 15/120.2
See application file for complete search history.

(56) References Cited

U.S. PATENT DOCUMENTS

| | | | | |
|---|---|---|---|---|
| 7,540,057 | B2 * | 6/2009 | Lin et al. | 15/229.6 |
| 8,272,093 | B2 * | 9/2012 | Wu | 15/229.1 |
| 2011/0247163 | A1 * | 10/2011 | Chen | 15/228 |

* cited by examiner

*Primary Examiner* — Shay Karls
(74) *Attorney, Agent, or Firm* — Alan Kamrath; Kamrath IP Lawfirm, P.A.

(57) ABSTRACT

A swivel mop includes a handle unit, a first rotation disk, a second rotation disk, a cleaning unit, and a plurality of linking cords. The handle unit includes an outer tube, a connecting cap, and an inner post. The first rotation disk is connected with the connecting cap. The second rotation disk is driven by the inner post. The cleaning unit includes a plurality of cloth strips connected with the first rotation disk. The linking cords are connected between the second rotation disk and the cloth strips. Thus, when the second rotation disk is rotated by the inner post, the linking cords are driven by the second rotation disk to drive the cloth strips so that the cloth strips are driven toward a central portion to shorten the extent of expansion of the cloth strips during the dehydration process.

5 Claims, 7 Drawing Sheets

SWIVEL MOP WITH REVOLVING DEHYDRATION FUNCTION

BACKGROUND OF THE INVENTION

1. Field of the Invention

The present invention relates to a swivel mop and, more particularly, to a swivel mop with revolving dehydration function.

2. Description of the Related Art

A conventional swivel mop comprises a barrel and a mop body mounted in the barrel. The barrel has an interior provided with a basket which is pivotally mounted in the barrel. The mop body includes a retractable handle unit, a mop head connected with the handle unit, a plurality of cloth strips mounted on the mop head, and a rotation mechanism mounted in the handle unit and connected with the mop head. When a user wishes to dehydrate the cloth strips, the mop head is placed in the basket of the barrel so that the cloth strips are gathered in the basket. Then, the handle unit is retracted to drive the rotation mechanism which drives the mop head to swivel relative to the handle unit rapidly so as to rotate and dehydrate the cloth strips by a centrifugal force. Thus, the user needs not to twist and dehydrate the cloth strips by his two hands, thereby facilitating the user dehydrating the cloth strips. However, the mop head is placed in and positioned by the basket of the barrel so that the user has to purchase the mop body and the barrel simultaneously, thereby increasing the cost of fabrication. In addition, the barrel has a larger size to receive the basket, thereby increasing the cost of packaging, storage and transportation.

BRIEF SUMMARY OF THE INVENTION

In accordance with the present invention, there is provided a swivel mop, comprising a handle unit, a first rotation disk, a second rotation disk, a cleaning unit, and a plurality of linking cords. The handle unit includes an outer tube, a connecting cap mounted on a lower end of the outer tube, and an inner post retractably and rotatably mounted in the outer tube and extendable outward from the connecting cap. The first rotation disk is connected with the connecting cap of the handle unit. The first rotation disk has a central portion provided with a mounting hole. The mounting hole of the first rotation disk has a peripheral wall provided with an annular positioning rib. The second rotation disk is connected with the first rotation disk. The second rotation disk has a central portion provided with a limit hole to allow passage of the inner post of the handle unit so that the second rotation disk is driven and rotated by the inner post of the handle unit. The second rotation disk has an outer periphery provided with a positioning portion. The second rotation disk has a surface provided with a plurality of slides each located between the positioning portion and the limit hole. Each of the slides of the second rotation disk is connected with the positioning rib of the first rotation disk so that the second rotation disk is rotatable along the positioning rib of the first rotation disk. The cleaning unit is connected with the first rotation disk. The cleaning unit includes a plurality of cloth strips connected with an outer periphery of the first rotation disk and a seam line connecting the cloth strips. The seam line of the cleaning unit is located between two opposite ends of each of the cloth strips. The linking cords are connected between the second rotation disk and the cloth strips of the cleaning unit. Each of the linking cords has a first end connected with the positioning portion of the second rotation disk and a second end connected with a respective one of the cloth strips of the cleaning unit. The linking cords are extended outward from the positioning portion of the second rotation disk in a radiating manner.

The primary objective of the present invention is to provide a swivel mop whose cloth strips are directed toward and gathered at the central portion of the swivel mop so as to shorten the expanding extent of the cloth strips during the swiveling dehydration process.

According to the primary advantage of the present invention, when the second rotation disk is rotated by the inner post, the linking cords are driven by the second rotation disk to drive the cloth strips toward the central portion of the second rotation disk so that the cloth strips are gathered toward the central portion of the second rotation disk to limit and shorten the extent of expansion of the cloth strips during the swivel dehydration process, thereby facilitating a user dehydrating the cloth strips.

According to another advantage of the present invention, the cloth strips have a smaller extent of expansion during rotation so that the cloth strips can be dehydrated in a basket with a normal size, thereby greatly decreasing the cost of fabrication, packaging, storage and transportation of the swivel mop.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
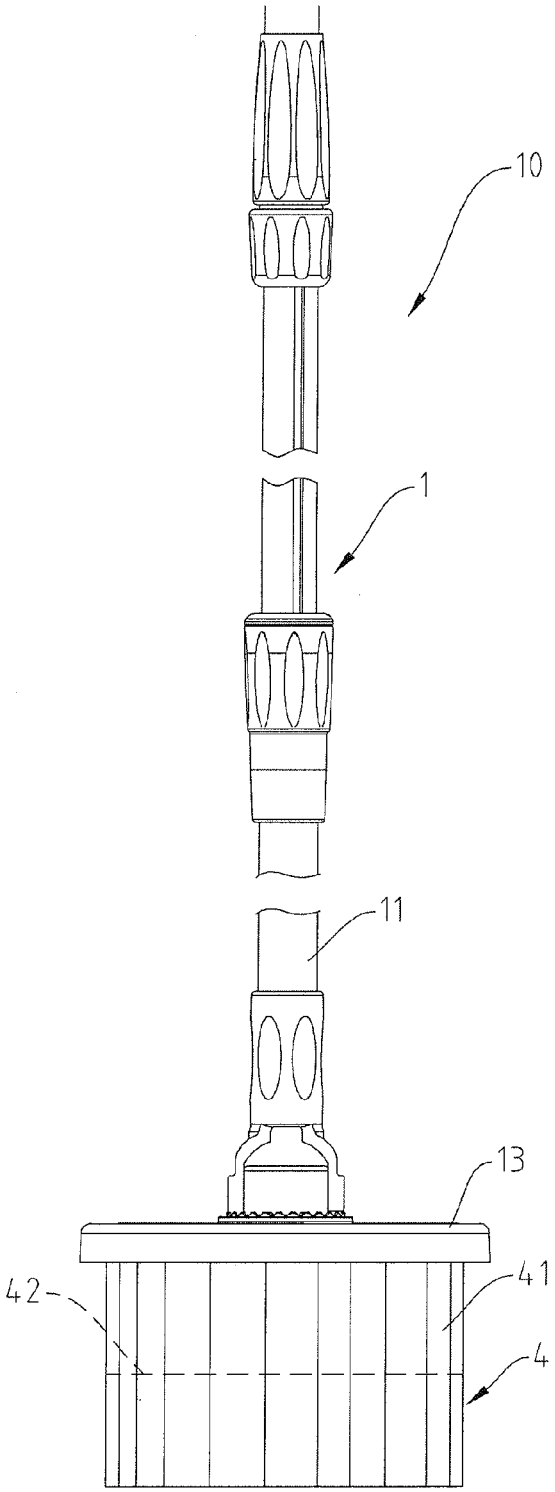
FIG. 1 is a front view of a swivel mop in accordance with the preferred embodiment of the present invention.

Referring to FIGS. 1-7, a swivel mop 10 in accordance with the preferred embodiment of the present invention comprises a handle unit 1, a first rotation disk 2, a second rotation disk 3, a cleaning unit 4, and a plurality of linking cords 5.

The handle unit 1 includes an outer tube 11, a connecting cap 13 mounted on a lower end of the outer tube 11, and an inner post 12 retractably and rotatably mounted in the outer tube 11 and extendable outward from the connecting cap 13. The inner post 12 of the handle unit 1 is driven by a first driving mechanism to rotate relative to the outer tube 11. The inner post 12 of the handle unit 1 has an outer periphery provided with a plurality of guiding tracks 121. The guiding tracks 121 of the inner post 12 are arranged in an annular manner and are equally spaced from each other. The connecting cap 13 of the handle unit 1 is driven by a second driving mechanism to rotate relative to the outer tube 11.

The first rotation disk 2 is connected with the connecting cap 13 of the handle unit 1 so that the first rotation disk 2 is driven by the connecting cap 13 of the handle unit 1 to rotate relative to the outer tube 11 of the handle unit 1. The first rotation disk 2 has a central portion provided with a mounting hole 21. The mounting hole 21 of the first rotation disk 2 has a peripheral wall provided with an annular positioning rib 22. The first rotation disk 2 has an outer periphery provided with a plurality of fixing portions 23. The fixing portions 23 of the first rotation disk 2 are equally spaced from each other.

The second rotation disk 3 is connected with the first rotation disk 2. The second rotation disk 3 has a central portion provided with a limit hole 32 to allow passage of the inner post 12 of the handle unit 1 so that the second rotation disk 3 is driven by the inner post 12 of the handle unit 1 to rotate relative to the outer tube 11 of the handle unit 1. The limit hole 32 of the second rotation disk 3 has an inner periphery provided with a plurality of guiding rails 321 locked onto the guiding tracks 121 of the inner post 12 so that the guiding tracks 121 of the inner post 12 are movable upward and downward along the guiding rails 321 of the second rotation disk 3. The guiding rails 321 of the second rotation disk 3 are arranged in an annular manner and are equally spaced from each other. The second rotation disk 3 has an outer periphery provided with a positioning portion 31. The second rotation disk 3 has a surface provided with a plurality of slides 33 each located between the positioning portion 31 and the limit hole 32. The slides 33 of the second rotation disk 3 are arranged in an annular manner and are equally spaced from each other. Each of the slides 33 of the second rotation disk 3 is connected with the positioning rib 22 of the first rotation disk 2 so that the second rotation disk 3 is rotatable along the positioning rib 22 of the first rotation disk 2. Preferably, each of the slides 33 of the second rotation disk 3 is resiliently snapped onto the positioning rib 22 of the first rotation disk 2.

Each of the slides 33 of the second rotation disk 3 has a lower end provided with a stop arm 331 resting on the positioning rib 22 of the first rotation disk 2 and an upper end provided with an abutting arm 332 abutting the positioning rib 22 of the first rotation disk 2. The abutting arm 332 of each of the slides 33 is directed toward the positioning portion 31 and the limit hole 32. Each of the slides 33 of the second rotation disk 3 has a side provided with a sliding channel 333 slidably mounted on the positioning rib 22 of the first rotation disk 2. The sliding channel 333 of each of the slides 33 is formed between the stop arm 331 and the abutting arm 332.

The cleaning unit 4 is connected with the first rotation disk 2. The cleaning unit 4 includes a plurality of cloth strips 41 connected with the outer periphery of the first rotation disk 2 and a seam line 42 connecting the cloth strips 41. The cloth strips 41 of the cleaning unit 4 are connected with the fixing portions 23 of the first rotation disk 2 respectively. The cloth strips 41 of the cleaning unit 4 are arranged in an annular manner. The seam line 42 of the cleaning unit 4 is located between two opposite ends of each of the cloth strips 41.

The linking cords 5 are connected between the second rotation disk 3 and the cloth strips 41 of the cleaning unit 4. Each of the linking cords 5 has a length smaller than that of each of the cloth strips 41 of the cleaning unit 4. Each of the linking cords 5 has a first end connected with the positioning portion 31 of the second rotation disk 3 and a second end connected with a respective one of the cloth strips 41 of the cleaning unit 4. The linking cords 5 are extended outward from the positioning portion 31 of the second rotation disk 3 in a radiating manner and are equally spaced from each other. Preferably, the linking cords 5 are connected with the cloth strips 41 of the cleaning unit 4 by the seam line 42 of the cleaning unit 4. Preferably, the linking cords 5 and the positioning portion 31 of the second rotation disk 3 are formed integrally by injection coating.

Figure 5:
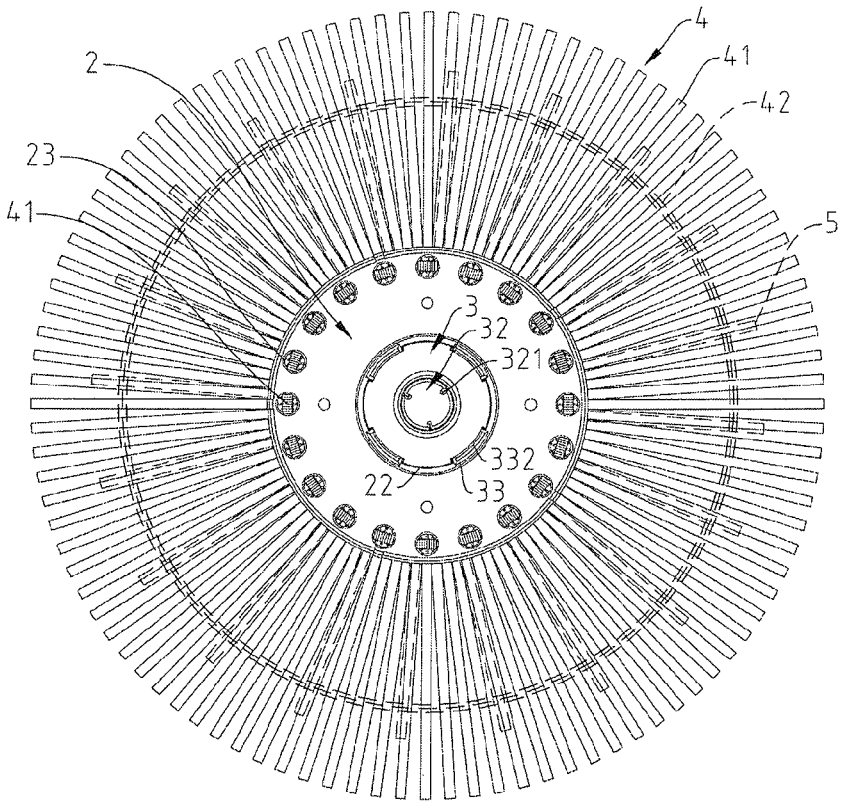
FIG. 5 is a partially top view of the swivel mop as shown in FIG. 1.
Figure 6:
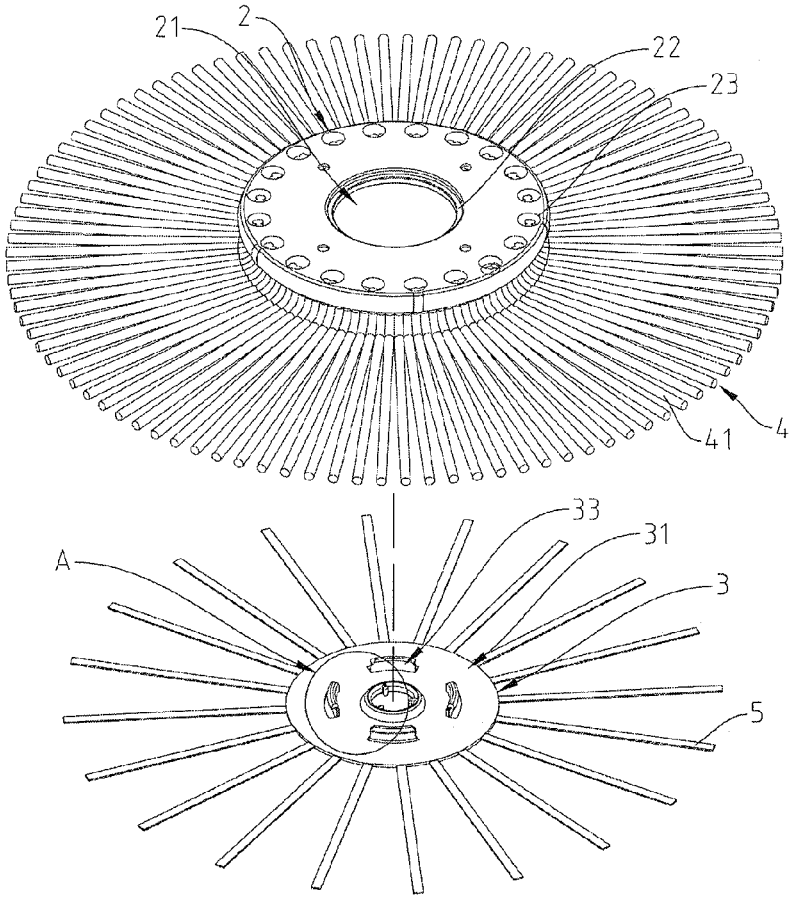
FIG. 6 is an exploded perspective view of the swivel mop as shown in FIG. 5.
Figure 7:
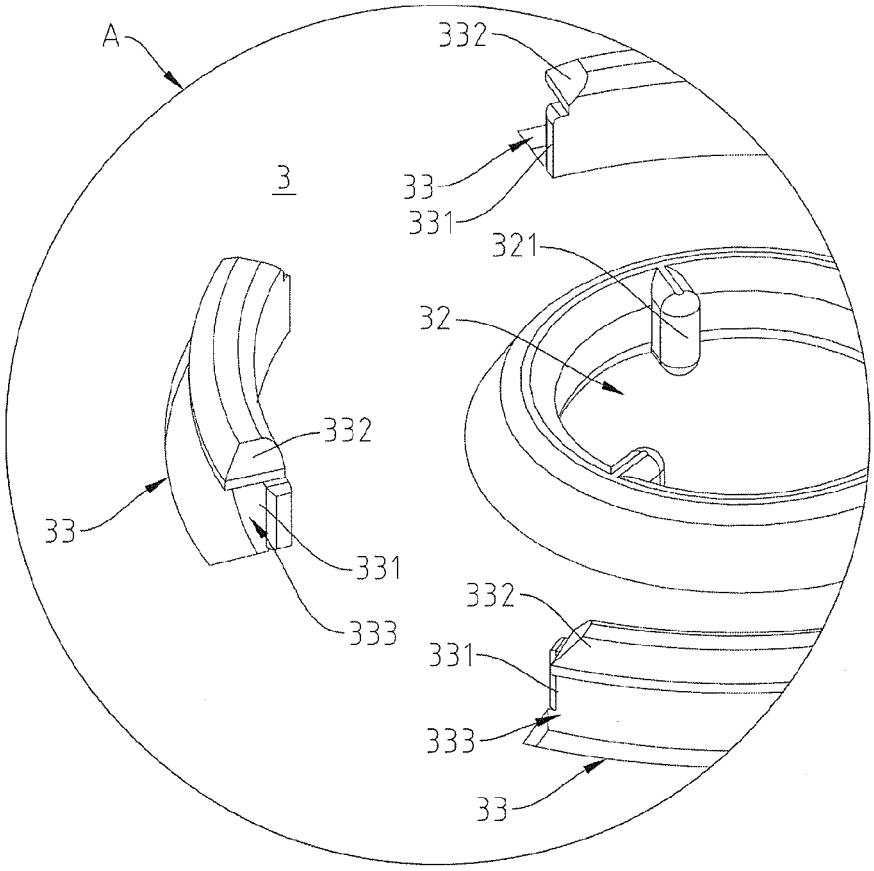
FIG. 7 is a locally enlarged view of the swivel mop taken along marking "A" as shown in FIG. 6.

In assembly, the cloth strips 41 of the cleaning unit 4 are connected with the fixing portions 23 of the first rotation disk 2 respectively. Then, the linking cords 5 are connected with the cloth strips 41 of the cleaning unit 4 by the seam line 42 of the cleaning unit 4. At this time, the cloth strips 41 of the cleaning unit 4 are initially arranged in a radiating manner and are then connected by the seam line 42 of the cleaning unit 4 as shown in FIG. 5 so that when the cloth strips 41 of the cleaning unit 4 are used, the cloth strips 41 of the cleaning unit 4 are expanded fully to have the optimum area. Then, each of the slides 33 of the second rotation disk 3 is snapped onto the positioning rib 22 of the first rotation disk 2 so that the sliding channel 333 of each of the slides 33 is locked onto the positioning rib 22 of the first rotation disk 2. Finally, the first rotation disk 2 is connected with the connecting cap 13 of the handle unit 1 to construct the swivel mop as shown in FIG. 1. At this time, the inner post 12 of the handle unit 1 is extendable outward from the connecting cap 13 and is extendable into the limit hole 32 of the second rotation disk 3, with the guiding tracks 121 of the inner post 12 engaging the guiding rails 321 of the second rotation disk 3 so that the second rotation disk 3 is rotatable in concert with the inner post 12 of the handle unit 1.

Figure 2:
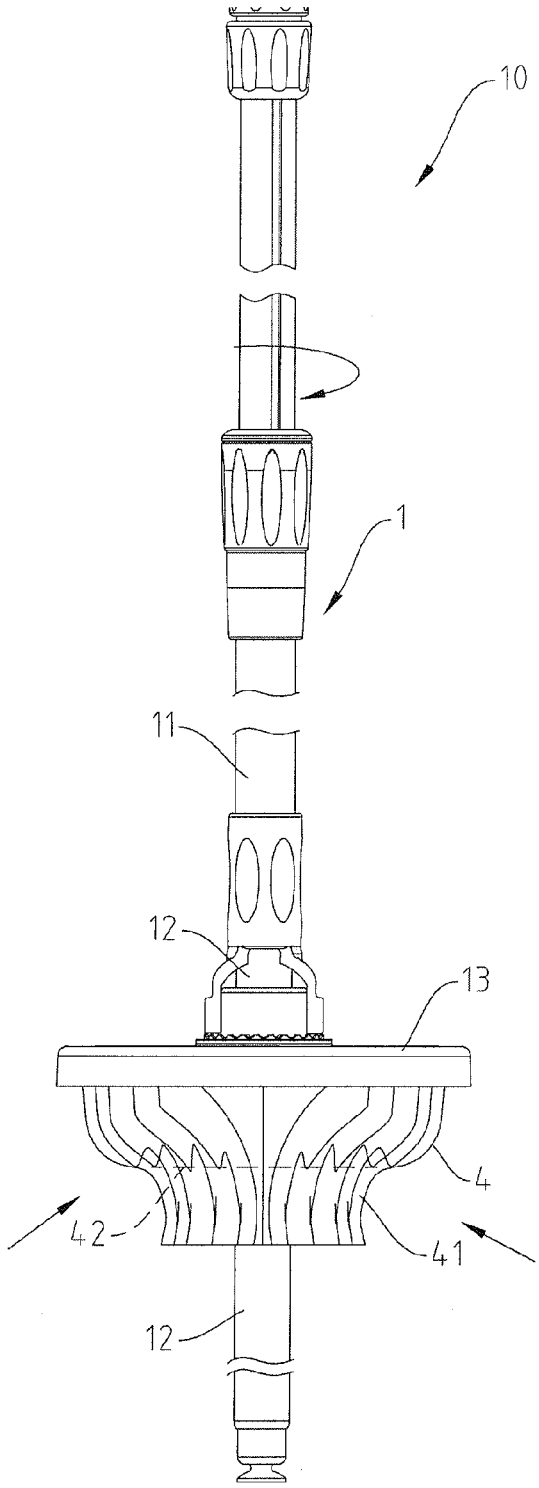
FIG. 2 is a schematic operational view of the swivel mop as shown in FIG. 1 in use.
Figure 3:
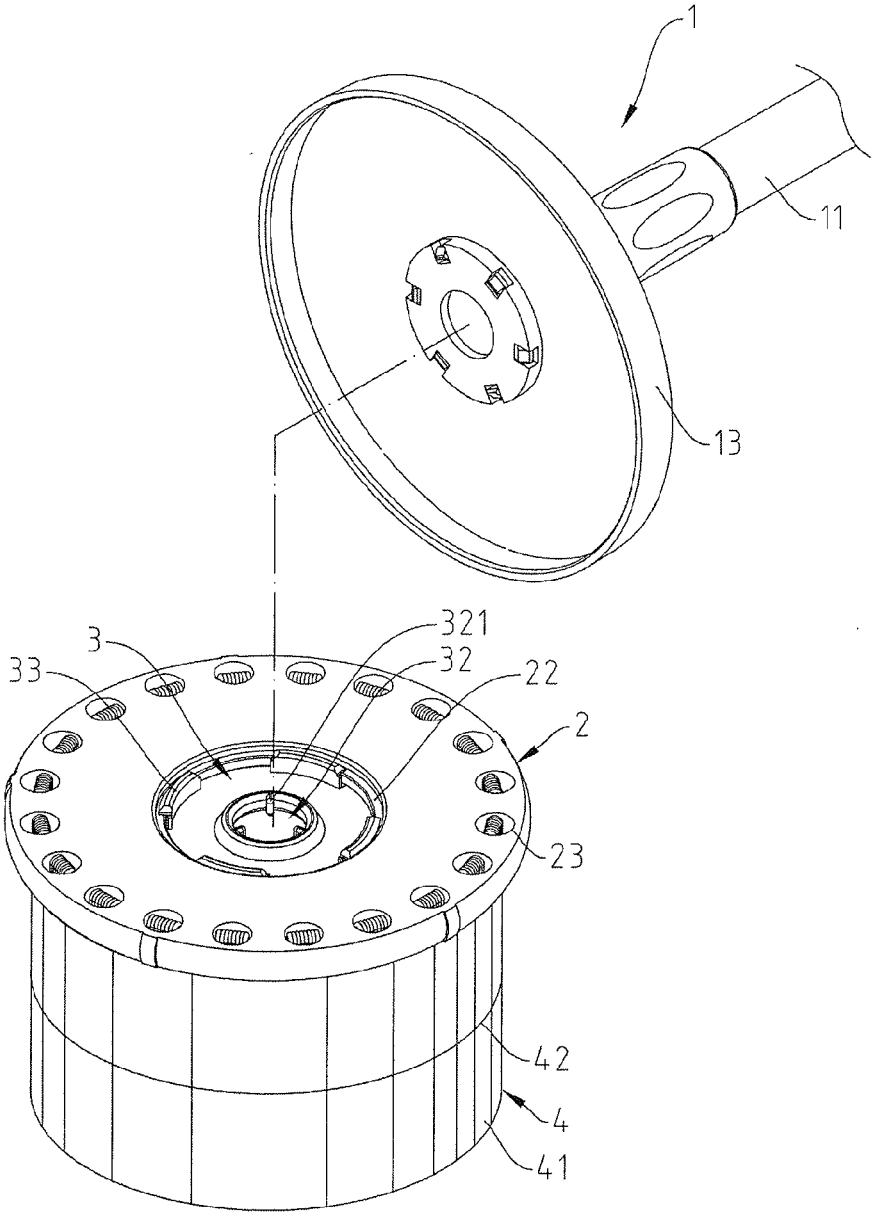
FIG. 3 is a partially exploded perspective view of the swivel mop as shown in FIG. 1.
Figure 4:
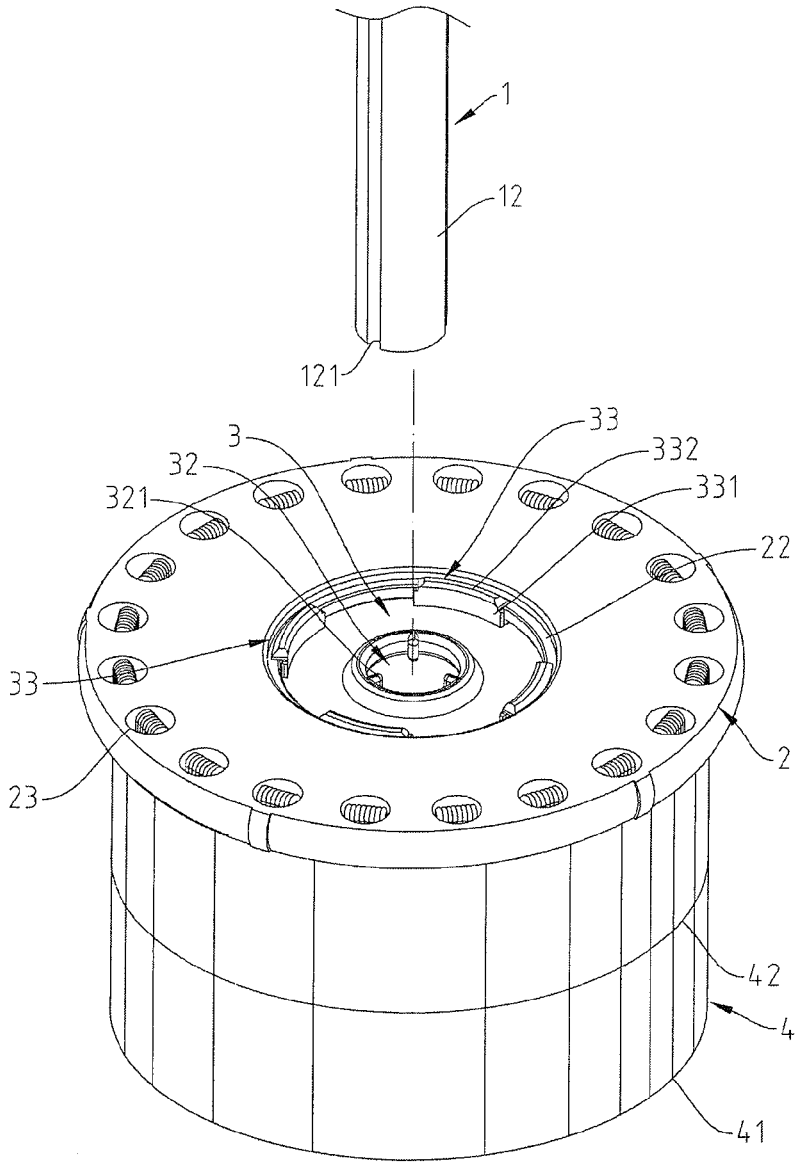
FIG. 4 is a partially exploded perspective view of the swivel mop as shown in FIG. 1.

In operation, when the handle unit 1 is driven, the inner post 12 of the handle unit 1 is driven by the first driving mechanism to rotate relative to the outer tube 11, and the connecting cap 13 of the handle unit 1 is driven by the second driving mechanism to rotate relative to the outer tube 11. In such a manner, when the inner post 12 of the handle unit 1 is driven, the inner post 12 in the outer tube 11 is extended outward from the connecting cap 13 and is extended into the limit hole 32 of the second rotation disk 3, with the guiding tracks 121 of the inner post 12 engaging the guiding rails 321 of the second rotation disk 3 so that the second rotation disk 3 is rotated in concert with the inner post 12 of the handle unit 1 to move the linking cords 5. In addition, when the connecting cap 13 of the handle unit 1 is driven, the first rotation disk 2 is driven and rotated by the connecting cap 13 of the handle unit 1 to move the cloth strips 41 of the cleaning unit 4. Thus, when the second rotation disk 3 is rotated, the linking cords 5 are driven by the second rotation disk 3 to move toward the central portion of the second rotation disk 3, and the cloth strips 41 of the cleaning unit 4 are driven by the linking cords 5 to move toward the central portion of the second rotation disk 3 as shown in FIG. 2 so that the cloth strips 41 of the cleaning unit 4 are folded and gathered toward the central portion of the second rotation disk 3.

Accordingly, when the second rotation disk 3 is rotated by the inner post 12, the linking cords 5 are driven by the second rotation disk 3 to drive the cloth strips 41 toward the central portion of the second rotation disk 3 so that the cloth strips 41 are gathered toward the central portion of the second rotation disk 3 to limit and shorten the extent of expansion of the cloth strips 41 during the swivel dehydration process, thereby facilitating a user dehydrating the cloth strips 41. In addition, the cloth strips 41 have a smaller extent of expansion during rotation so that the cloth strips 41 can be dehydrated in a basket with a normal size, thereby greatly decreasing the cost of fabrication, packaging, storage and transportation of the swivel mop.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A swivel mop, comprising:

a handle unit, a first rotation disk, a second rotation disk, a cleaning unit, and a plurality of linking cords; wherein the handle unit includes an outer tube, a connecting cap mounted on a lower end of the outer tube, and an inner post retractably and rotatably mounted in the outer tube and extendable outward from the connecting cap;

the first rotation disk is connected with the connecting cap of the handle unit;

the first rotation disk has a central portion provided with a mounting hole;

the mounting hole of the first rotation disk has a peripheral wall provided with an annular positioning rib;

the second rotation disk is connected with the first rotation disk;

the second rotation disk has a central portion provided with a limit hole to allow passage of the inner post of the handle unit so that the second rotation disk is driven and rotated by the inner post of the handle unit;

the second rotation disk has an outer periphery provided with a positioning portion;

the second rotation disk has a surface provided with a plurality of slides each located between the positioning portion and the limit hole;

each of the slides of the second rotation disk is connected with the positioning rib of the first rotation disk so that the second rotation disk is rotatable along the positioning rib of the first rotation disk;

the cleaning unit is connected with the first rotation disk;

the cleaning unit includes a plurality of cloth strips connected with an outer periphery of the first rotation disk and a seam line connecting the cloth strips;

the seam line of the cleaning unit is located between two opposite ends of each of the cloth strips;

the linking cords are connected between the second rotation disk and the cloth strips of the cleaning unit;

each of the linking cords has a first end connected with the positioning portion of the second rotation disk and a second end connected with a respective one of the cloth strips of the cleaning unit; and the linking cords are extended outward from the positioning portion of the second rotation disk in a radiating manner.

2. The swivel mop of claim 1, wherein the inner post of the handle unit has an outer periphery provided with a plurality of guiding tracks;

the guiding tracks of the inner post are arranged in an annular manner and are equally spaced from each other;

the limit hole of the second rotation disk has an inner periphery provided with a plurality of guiding rails locked onto the guiding tracks of the inner post so that the guiding tracks of the inner post are movable upward and downward along the guiding rails of the second rotation disk; and the guiding rails of the second rotation disk are arranged in an annular manner and are equally spaced from each other.

3. The swivel mop of claim 1, wherein each of the slides of the second rotation disk has a lower end provided with a stop arm resting on the positioning rib of the first rotation disk and an upper end provided with an abutting arm abutting the positioning rib of the first rotation disk;

the abutting arm of each of the slides is directed toward the positioning portion and the limit hole;

each of the slides of the second rotation disk has a side provided with a sliding channel slidably mounted on the positioning rib of the first rotation disk; and the sliding channel of each of the slides is formed between the stop arm and the abutting arm.

4. The swivel mop of claim 1, wherein the linking cords are connected with the cloth strips of the cleaning unit by the seam line of the cleaning unit.

5. The swivel mop of claim 1, wherein the linking cords and the positioning portion of the second rotation disk are formed integrally by injection coating.

* * * * *